US006269985B1

(12) United States Patent
Brody

(10) Patent No.: US 6,269,985 B1
(45) Date of Patent: Aug. 7, 2001

(54) DEVICE FOR SECURING A SPRAY CAN DISPENSING TUBE

(75) Inventor: Harvey Brody, Costa Mesa, CA (US)

(73) Assignee: Delshar, Inc., Santa Ana, CA (US)

( * ) Notice: Subject to any disclaimer, the term of this patent is extended or adjusted under 35 U.S.C. 154(b) by 0 days.

(21) Appl. No.: 09/648,700

(22) Filed: Aug. 25, 2000

(51) Int. Cl.[7] ..... B65D 83/28
(52) U.S. Cl. ..... 222/538
(58) Field of Search ..... 222/538

(56) References Cited

U.S. PATENT DOCUMENTS

| | | | | |
|---|---|---|---|---|
| 3,199,751 | | 8/1965 | Jovanovich | 222/543 |
| 3,445,033 | | 5/1969 | Sweet et al. | 220/90.2 |
| 4,121,835 | | 10/1978 | Garabedian | 274/1 R |
| 4,819,838 | * | 4/1989 | Hart, Jr. | 222/538 |
| 4,823,445 | * | 4/1989 | Diener | 222/538 X |
| 4,858,792 | | 8/1989 | de Laforcade | 222/533 |
| 5,018,635 | | 5/1991 | Whittaker | 220/533 |
| 5,044,512 | | 9/1991 | Giancaspro et al. | 220/90.2 |
| 5,048,709 | | 9/1991 | Alverson | 220/90.2 |
| 5,058,793 | | 10/1991 | Antonelli | 222/538 |
| 5,297,704 | | 3/1994 | Stollmeyer | 222/567 |
| 5,328,069 | | 7/1994 | Cohanfard | 224/148 |
| 5,529,226 | | 6/1996 | Alberth, Jr. | 222/402.1 |
| 5,544,783 | * | 8/1996 | Conigliaro | 222/538 X |
| 5,772,084 | * | 6/1998 | Yale et al. | 222/538 X |
| 5,887,767 | | 3/1999 | Riley et al. | 222/538 |
| 5,992,678 | * | 11/1999 | Willey | 220/735 |
| 6,102,258 | * | 8/2000 | Riley et al. | 222/538 |

FOREIGN PATENT DOCUMENTS

| | | | |
|---|---|---|---|
| 3937278 | 5/1991 | (DE) | B65D/25/48 |
| 2381683 | 9/1978 | (FR) | B65D/47/20 |

* cited by examiner

*Primary Examiner*—Kenneth Bomberg
(74) *Attorney, Agent, or Firm*—Klein & Szekeres LLP

(57) ABSTRACT

A device for securing a dispensing tube to an aerosol spray can includes an apertured retention tab that is mountable to the side of the can, wherein the retention tab, when so mounted, is resiliently flexible from a first position, substantially parallel to the side of the can, to a radially-outward second position. When the retention tab is held in the second position, the aperture in the retention tab extends substantially parallel to the side of the can, thereby permitting a dispensing tube to be inserted through the aperture with an orientation substantially parallel to the axis of the can. When the retention tab is released, it resiliently returns to the first position, in which the retention tab clamps the tube against the side of the can. In a preferred embodiment, the retention tab is attached to an elastic band that may be placed around the can to mount the retention tab on the can. Also attached to the band, adjacent the retention tab, is an elongate pull tab that is positioned and configured so that, when it is pulled radially outwardly from the can, it moves the retention tab from the first position to the second position. In an alternative embodiment, the retention tab is formed as an integral part of a flexible plastic body having a mounting portion that may be adhesively attached to the side of the can.

6 Claims, 3 Drawing Sheets

DEVICE FOR SECURING A SPRAY CAN DISPENSING TUBE

CROSS-REFERENCE TO RELATED APPLICATION

Not Applicable

FEDERALLY SPONSORED RESEARCH OR DEVELOPMENT

Not Applicable

BACKGROUND OF THE INVENTION

The present invention relates generally to aerosol spray cans, of the type having a push-button aerosol spray valve. Such spray cans often employ, and may be supplied with, a dispensing tube that removably fits into the orifice of the spray valve to allow the contents of the can to be dispensed into a small space. Specifically, the present invention relates to a device for securing the dispensing tube to the can when the dispensing tube is not in use, so as to reduce the possibility that the tube may be misplaced or lost.

In using spray cans with dispensing tubes, the dispensing tube is typically separated from the can when not in use. As a result, the tube may be lost or misplaced. Several devices have been developed to address this problem. For example, U.S. Pat. No. 5,887,767—Riley et al. discloses a dispensing tube holder comprising a flexible tether that has a first end connected to a ring or band that encircles the can, and a second end that is attached to the tube. A similar concept is disclosed in U.S. Pat. No. 5,058,783—Antonelli, in which the first end of the tether is attached to a holding element that is secured to the side of the can. U.S. Pat. No. 4,819,838—Hart, Jr. discloses a device comprising a ring that is secured to the can or a cap for the can. Extending outwardly from the ring is a tab or arm having an aperture through which the tube is inserted.

While the prior art has offered the above-described devices and others to address the problem of securing the dispensing tube, other approaches have been sought in attempts to make such devices easier to use and/or more economical to manufacture.

SUMMARY OF THE INVENTION

Broadly, the present invention is a device for securing a dispensing tube to an aerosol spray can, comprising an apertured retention tab that is mountable to the side of the can, wherein the retention tab, when so mounted, is resiliently flexible from a first position, substantially parallel to the side of the can, to a flexed or second position. When the retention tab is held in the flexed position, it extends radially outward from the side of the can, and the aperture in the retention tab extends substantially parallel to the side of the can, thereby permitting a dispensing tube, having an outside diameter approximately equal to the inside diameter of the aperture, to be inserted through the aperture in an orientation that is substantially parallel to the axis of the can. When the retention tab is released, it resiliently returns to the first position, in which the retention tab clamps the tube against the side of the can.

In a preferred embodiment, the retention tab is attached to an elastic band that may be placed around the can to mount the retention tab on the can. Also attached to the band, adjacent the retention tab, is an elongate pull tab. The pull tab is positioned and configured so that, when it is pulled radially outwardly from the can, it moves the retention tab from the first position to the second position. Also, the pull tab provides a convenient grip for pulling the elastic band of the device off of the can.

In an alternative embodiment, the retention tab is formed as an integral part of a flexible plastic body having a mounting portion that may be adhesively attached to the side of the can. In this embodiment, the pull tab may be omitted to save manufacturing costs. Without the pull tab, the retention tab is directly manipulated to move it from its first position to its second position.

As will be better appreciated from the detailed description that follows, the present invention offers a device for securing an aerosol can dispensing tube that is both easy to use and economical to manufacture.

DETAILED DESCRIPTION OF THE INVENTION

Figure 1:
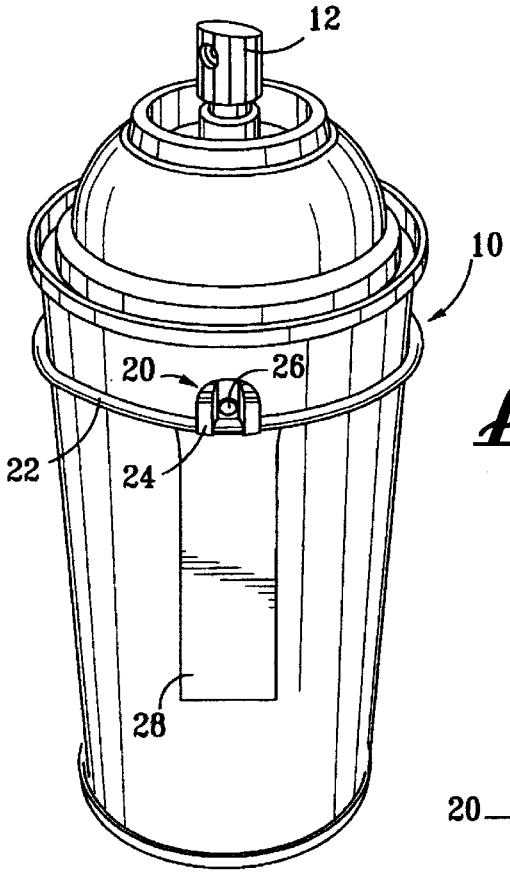
FIG. 1 is a perspective view of a dispensing tube securing device, in accordance with a preferred embodiment of the present invention, mounted to an aerosol can.
Figure 2:
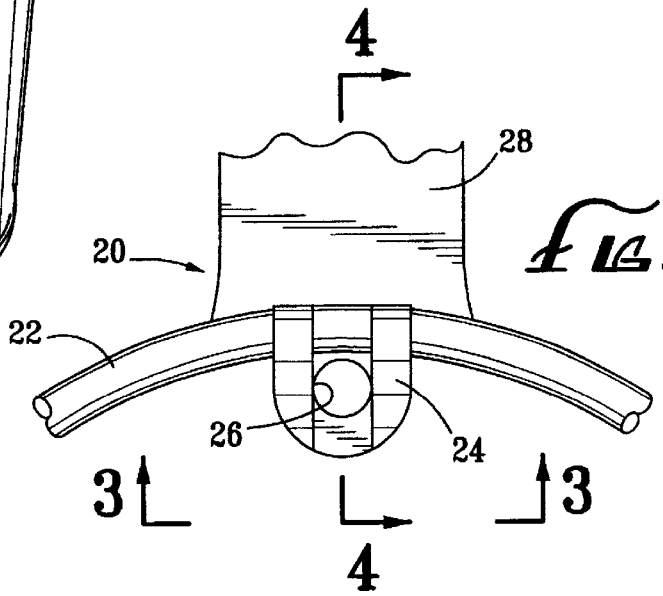
FIG. 2 is a partial plan view of the preferred embodiment of the present invention.
Figure 3:
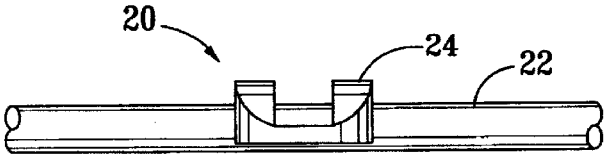
FIG. 3 is an elevational view taken along line 3—3 of FIG. 2.
Figure 4:
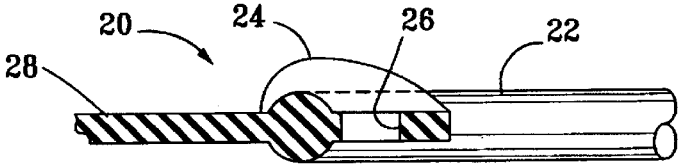
FIG. 4 is a cross-sectional view taken along line 4—4 of FIG. 2.

FIG. 1 shows a typical aerosol can 10 with a dispensing tube securing device 20, in accordance with a preferred embodiment of the present invention. The can 10 is of conventional design, equipped with an aerosol spray valve 12. The device 20 is shown securing a dispensing tube 30 to the side of the can 10, when the dispensing tube 30 is not in use.

As shown in FIGS. 1–4, the dispensing tube securing device 20 comprises an elastic ring or band 22 to which is attached a retention tab 24 with an aperture 26. An elongated pull tab 28 is attached to the band 22 under the retention tab 24 (that is, at approximately the same circumferential position on the band 22 as the retention tab 24), and depends downwardly from the band 22. Preferably, the band 22, retention tab 24, and pull tab 28 are formed as a molded unit from a suitable elastomeric plastic. The band 22 has a normal, relaxed inside diameter that is smaller than the outside diameter of the can 10, so that it can be stretched to fit around the can 10 with a snug, secure fit.

The retention tab 24 is formed so that it has a normal first position, shown in FIG. 1, in which it is oriented substantially parallel with the axis of the band 22. When the device 20 is secured around the can 10 by means of the elastic band 22, the retention tab 24 assumes its normal position, which, in the orientation shown in the drawings, brings it substantially upright alongside of, and substantially parallel to, the side of the can 10 (i.e., substantially parallel to the axis of the can). In this first position, the aperture 26 is aligned substantially perpendicular to the axis of the can.

Figure 8:
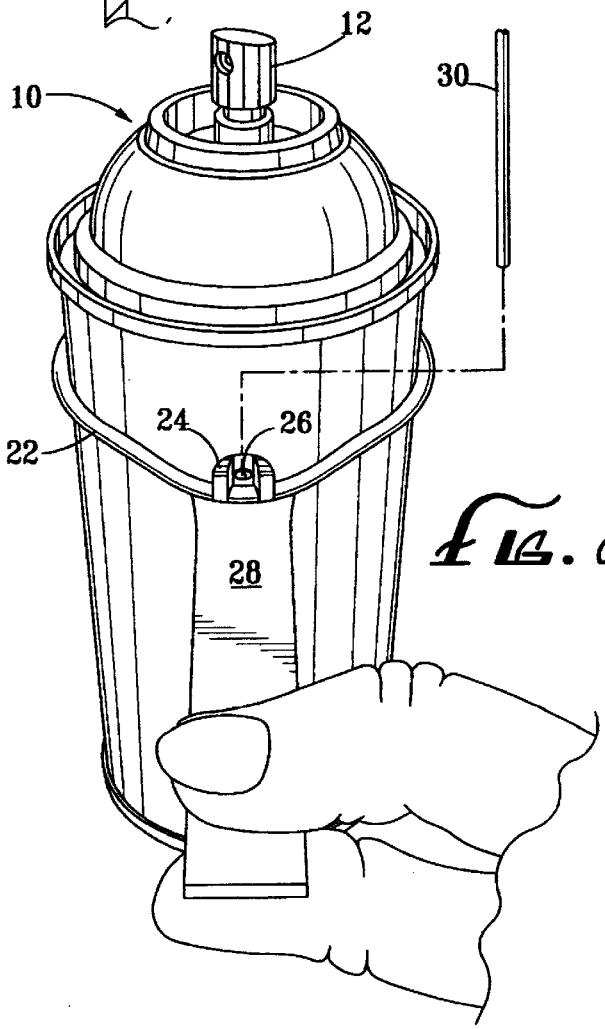
FIG. 8 is a perspective view of an aerosol can with a dispensing tube securing device in accordance with the preferred embodiment of the invention, showing the process of installing a dispensing tube in the device.

The retention tab 24 is movable from the normal first position to a second, or flexed position (FIGS. 2, 3, 4, and 8), in which it is caused to extend radially outward from the side of the can 10, with the aperture 26 being aligned substantially parallel to the axis of the can 10. Thus movement from the first position to the second position is effected by pulling the pull tab 28 away from the side of the can 10, as shown in FIG. 8. When the pull tab 28 is released, the retention tab 24 resiliently returns to its first position.

Figure 6:
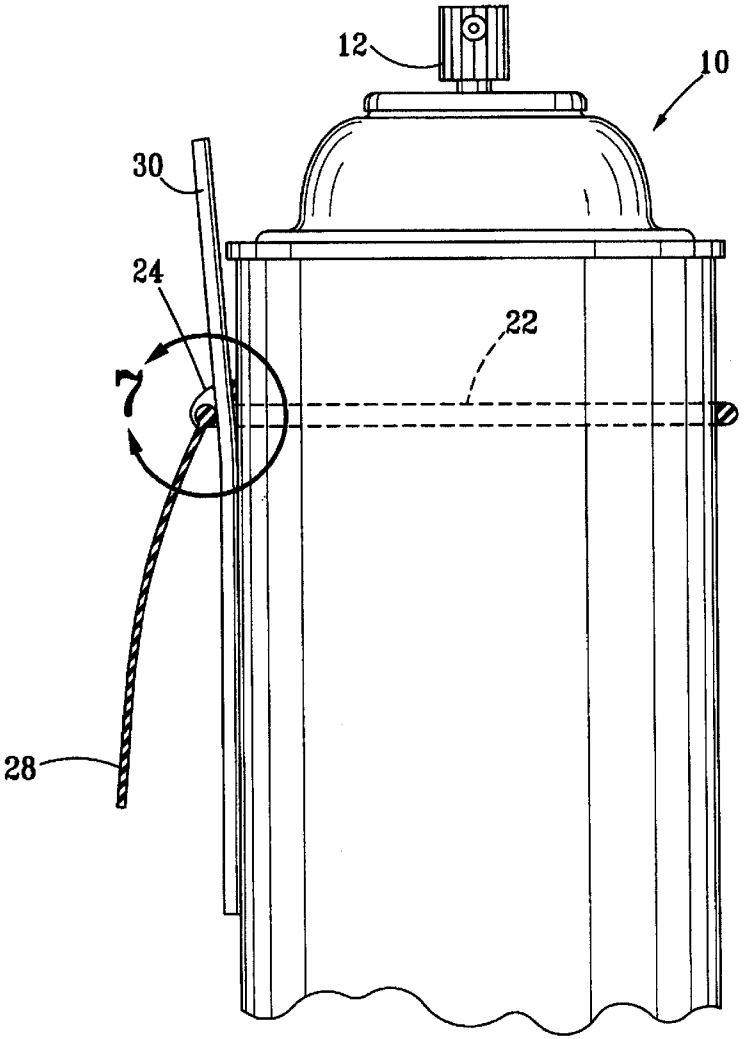
FIG. 6 is an elevational view similar to that of FIG. 5, but rotated 90 degrees about a vertical axis so as to show the dispensing tube securing device in side elevation.
Figure 5:
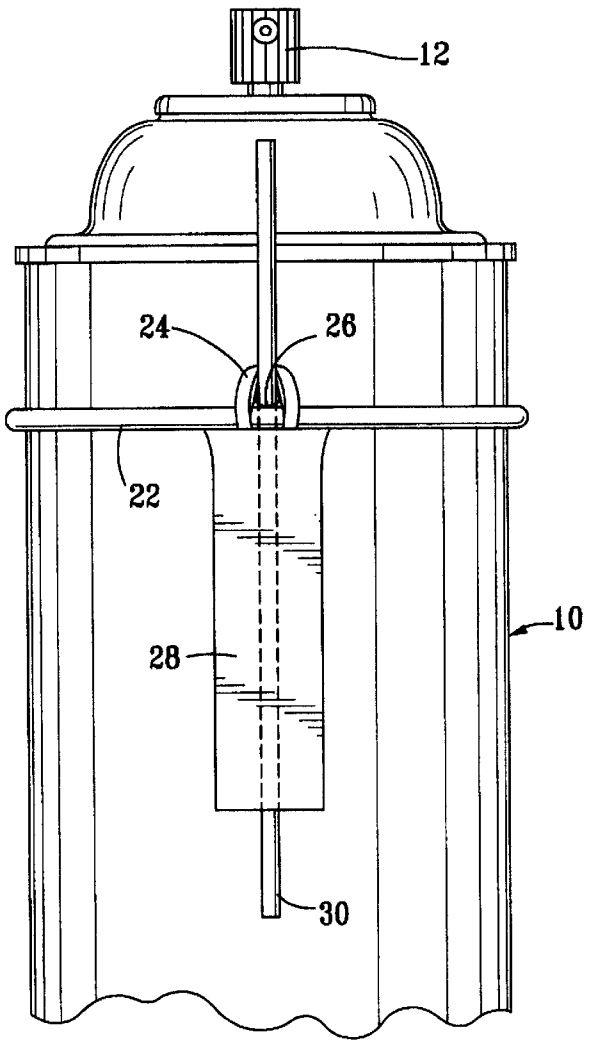
FIG. 5 is an elevational view of an aerosol can showing, in front elevation, a dispensing tube securing device in accordance with the preferred embodiment of the present invention, with a dispensing tube being held by the device.
Figure 7:
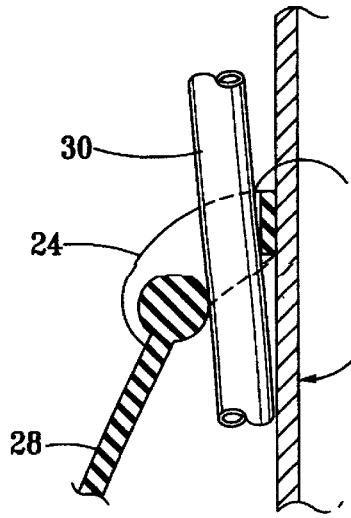
FIG. 7 is a detailed view, in cross-section, of the area within the circle 7 in FIG. 6.

In operation, the device 20 is secured to an aerosol can 10 by means of the elastic band 22, as described above. The retention tab 24 assumes the first (substantially upright) normal position (FIG. 1). The pull tab 28 is pulled radially away from the side of the can 10, as shown in FIG. 8, whereby the retention tab 24 is flexibly moved to its second (flexed) position, as described above. In this second position, the aperture 26 is aligned substantially parallel to the side of the can 10 (that is, substantially parallel to the axis of the can). In this position, a dispensing tube 30 can easily be inserted through the aperture 26 in an orientation substantially parallel to the axis of the can. When the pull tab 28 is released, the retention tab 24 elastically springs back toward its first position, capturing and securing the dispensing tube 30 against the side of the can 10, as shown in FIGS. 5, 6, and 7. To release the dispensing tube 30 for use, the pull tab 28 is again pulled radially away from the can 10 to move the retention tab 24 to its second position, thereby allowing the dispensing tube 30 to be easily removed from the retention tab 24 for insertion into the spray valve 12 of the can 10.

Figure 9:
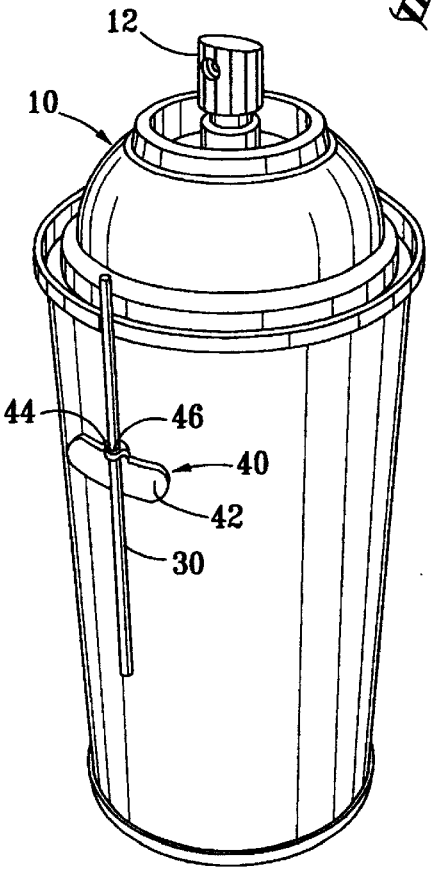
FIG. 9 is a perspective view of an aerosol can with a dispensing tube securing device in accordance with an alternative embodiment of the present invention.

FIG. 9 shows another dispensing tube securing device 40, in accordance with an alternative embodiment of the invention. In this embodiment, the device 40 comprises a substantially planar mounting portion 42 to which is attached a retention tab 44 having an aperture 46. As in the preferred embodiment, the device 40 is preferably molded as a unit from a suitable elastomeric plastic, so that the retention tab 44 is integral with the mounting portion 42. The device 40 is characterized by its extremely low cost of manufacture, lacking both a pull tab and an elastic band.

The device 40 is attached to the side of the can 10 by a suitable adhesive applied to the mounting portion 42. The retention tab 44, like the analogous structure in the preferred embodiment described above, normally assumes a substantially upright first position, aligned substantially parallel to the side of the can 10. In this first position, the aperture is aligned substantially perpendicular to the axis of the can 10.

The retention tab 44 is movable, by direct manipulation (there being no pull tab), to a second, flexed position, in which the aperture 46 is aligned substantially parallel to the side and axis of the can, thereby allowing a dispensing tube 30 to be inserted through the aperture 46. When the retention tab 44 is released, it springs back elastically toward its first position to capture and secure the dispensing tube 30 against the side of the can 10.

From the foregoing description, it can be seen that the present invention provides an inexpensive yet effective mechanism for securing a dispensing tube to an aerosol spray can for temporary storage until the dispensing tube is used.

While a preferred embodiment and an alternative embodiment have been described herein, it will be appreciated that a number of variations and modifications will suggest themselves to those skilled in the pertinent arts. For example, either embodiment can be made with two or more retention tabs. Also, the pull tab 28 in the preferred embodiment can be made in a wide variety of shapes and sizes. It may also be contemplated to create a dispensing tube securing device having a retention tab attached to an elastic band, but without any pull tab. These and other variations and modifications should be considered within the spirit and scope of the present invention, as defined in the claims that follow.

What is claimed is:

1. A device for securing a dispensing tube to a spray can, comprising:

a substantially planar mounting portion configured for attachment to the side of a spray can; and a retention tab formed as a unit with the mounting portion and having an aperture dimensioned to receive a dispensing tube;

wherein, when the mounting portion is attached to the side of the can, the retention tab is resiliently flexible from a first position, substantially parallel to the side of the can, to a second position in which the retention tab extends radially outward from the side of the can, and the aperture in the retention tab is oriented substantially parallel to the side of the can, thereby permitting the dispensing tube to be inserted through the aperture in an orientation substantially parallel to the axis of the can; and wherein, when the retention tab is released, it resiliently returns to the first position.

2. A device for securing a dispensing tube to a spray can, comprising:

a retention tab having an aperture configured to receive a dispensing tube;

means for mounting the retention tab on a spray can, the means for mounting including an elastic band to which the retention tab is attached;

wherein, when the retention tab is mounted on a spray can, the retention tab is resiliently flexible from a first position, substantially parallel to the side of the can, to a second position in which the retention tab extends radially outward from the side of the can, and the aperture in the retention tab is oriented substantially parallel to the side of the can, thereby permitting the dispensing tube to be inserted through the aperture in an orientation substantially parallel to the axis of the can, and wherein, when the retention tab is released, it resiliently returns to the first position; and a pull tab attached to the elastic band located adjacent the retention tab so as to facilitate the movement of the retention tab from the first position to the second position.

3. A device for securing a dispensing tube to a spray can, comprising:

a retention tab formed as an integral part of a flexible plastic body and having an aperture configured to receive a dispensing tube; and means for mounting the retention tab on a spray can, the means for mounting including a substantially planar mounting portion of the plastic body;

wherein, when the retention tab is mounted on a spray can, the retention tab is resiliently flexible from a first position, substantially parallel to the side of the can, to a second position in which the retention tab extends radially outward from the side of the can, and the aperture in the retention tab is oriented substantially parallel to the side of the can, thereby permitting the dispensing tube to be inserted through the aperture in an orientation substantially parallel to the axis of the can; and wherein, when the retention tab is released, it resiliently returns to the first position.

4. A device for securing a dispensing tube to a spray can, comprising:

an elastic band dimensioned to fit elastically around a spray can; and a retention tab having an aperture dimensioned to receive a dispensing tube, the retention tab being attached to the elastic band so that, when the elastic band is fitted around the can, the retention tab is resiliently flexible from a first position, substantially parallel to the side of the can, to a second position in which the retention tab extends radially outward from the side of the can, and the aperture in the retention tab is oriented substantially parallel to the side of the can, thereby permitting the dispensing tube to be inserted through the aperture in an orientation substantially parallel to the axis of the can, and wherein, when the retention tab is released, it resiliently returns to the first position; and a pull tab attached to the elastic band located adjacent the retention tab so as to facilitate the movement of the retention tab from the first position to the second position.

5. The device of claim 4, wherein the retention tab and the elastic band are formed as a unit.

6. The device of claim 4, wherein the retention tab, the pull tab, and the elastic band are formed as a unit.

* * * * *